US006260589B1

(12) United States Patent
Zeppieri et al.

(10) Patent No.: US 6,260,589 B1
(45) Date of Patent: Jul. 17, 2001

(54) LIQUID COLLECTION APPARATUS

(76) Inventors: Roberto Zeppieri; Luciano Di Luciano, both of 89 Timber Lane, Woodbridge, Ontario (CA), L4L 3J6

( * ) Notice: Subject to any disclaimer, the term of this patent is extended or adjusted under 35 U.S.C. 154(b) by 0 days.

(21) Appl. No.: 09/586,024

(22) Filed: Jun. 2, 2000

(51) Int. Cl.[7] ..... B65B 1/04
(52) U.S. Cl. ..... 141/106; 141/364
(58) Field of Search ..... 141/106, 105, 141/364, 365, 366, 98, 231, 375, 332; 248/94

(56) References Cited

U.S. PATENT DOCUMENTS

| | | | | |
|---|---|---|---|---|
| 205,665 | * | 7/1878 | Miller et al. . | |
| 232,141 | * | 9/1880 | Moseley | 141/364 |
| 483,664 | * | 10/1892 | Aborn . | |
| 1,667,075 | * | 4/1928 | Lippold . | |
| 1,710,588 | * | 4/1929 | Nagy | 141/106 |
| 1,742,150 | * | 12/1929 | Rollins | 141/106 |
| 1,861,619 | * | 6/1932 | Bellmer . | |
| 2,059,997 | * | 11/1936 | Kaestner . | |
| 2,133,770 | * | 10/1938 | McGlohon | 141/364 |
| 2,366,529 | * | 1/1945 | Hoff | 141/106 |
| 2,591,526 | * | 4/1952 | Fales, Sr. et al. . | |
| 3,643,704 | * | 2/1972 | Carr | 141/106 |
| 5,188,156 | * | 2/1993 | Littlepage | 141/106 |
| 5,269,354 | * | 12/1993 | Koberg | 141/106 |
| 5,611,377 | * | 3/1997 | Maguire | 141/106 |
| 5,950,698 | * | 9/1999 | Cristea et al. | 141/364 |

* cited by examiner

*Primary Examiner*—Gregory L. Huson
*Assistant Examiner*—Khoa Huynh

(57) ABSTRACT

A liquid collection apparatus for easily collecting and disposing of liquid waste such as oil. The liquid collection apparatus includes a container member having end walls, an open top, and a bottom wall which has a first and second side portions which are slanted downwardly and toward a centrally-disposed longitudinal channel with the bottom wall being slanted downwardly from one end wall to the other end wall; and also includes a spigot member securely disposed in the other end wall; and further either includes a plurality of compartments disposed inside the container member and being spaced above the bottom wall with a screen member disposed between the bottom of the compartments and the bottom wall or includes a base member having pole-like support members extending upwardly therefrom with each pole-like support member having branch members which are adapted to support an upside down liquid-containing member.

4 Claims, 4 Drawing Sheets

28

12
25
11
2
3
14
3
26
19
2
20
20
19
37

LIQUID COLLECTION APPARATUS

BACKGROUND OF THE INVENTION

1. Field of the Invention

The present invention relates to a liquid draining apparatus and more particularly pertains to a new liquid collection apparatus for easily collecting and disposing of liquid waste such as oil.

2. Description of the Prior Art

The use of liquid draining apparatus is known in the prior art. More specifically, liquid draining apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,540,264; U.S. Pat. No. 4,207,933; U.S. Pat. No. 5,522,437; U.S. Pat. No. 3,286,849; U.S. Pat. No. 2,728,488; and U.S. Pat. No. Des. 360,214.

While these devices fulfill their respective, particular objectives and requirements, the aforementioned patents do not disclose a new liquid collection apparatus. The inventive device includes a container member having end walls, an open top, and a bottom wall which has a first and second side portions which are slanted downwardly and toward a centrally-disposed longitudinal channel with the bottom wall being slanted downwardly from one end wall to the other end wall; and also includes a spigot member securely disposed in the other end wall; and further either includes a plurality of compartments disposed inside the container member and being spaced above the bottom wall with a screen member disposed between the bottom of the compartments and the bottom wall or includes a base member having pole-like support members extending upwardly therefrom with each pole-like support member having branch members which are adapted to support an upside down liquid-containing member.

In these respects, the liquid collection apparatus according to the present invention substantially departs from the conventional concepts and designs of the prior art, and in so doing provides an apparatus primarily developed for the purpose of easily collecting and disposing of liquid waste such as oil.

SUMMARY OF THE INVENTION

In view of the foregoing disadvantages inherent in the known types of liquid draining apparatus now present in the prior art, the present invention provides a new liquid collection apparatus construction wherein the same can be utilized for easily collecting and disposing of liquid waste such as oil.

The general purpose of the present invention, which will be described subsequently in greater detail, is to provide a new liquid collection apparatus which has many of the advantages of the liquid draining apparatus mentioned heretofore and many novel features that result in a new liquid collection apparatus which is not anticipated, rendered obvious, suggested, or even implied by any of the prior art liquid draining apparatus, either alone or in any combination thereof.

To attain this, the present invention generally comprises a container member having end walls, an open top, and a bottom wall which has a first and second side portions which are slanted downwardly and toward a centrally-disposed longitudinal channel with the bottom wall being slanted downwardly from one end wall to the other end wall; and also includes a spigot member securely disposed in the other end wall; and further either includes a plurality of compartments disposed inside the container member and being spaced above the bottom wall with a screen member disposed between the bottom of the compartments and the bottom wall or includes a base member having pole-like support members extending upwardly therefrom with each pole-like support member having branch members which are adapted to support an upside down liquid-containing member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new liquid collection apparatus which has many of the advantages of the liquid draining apparatus mentioned heretofore and many novel features that result in a new liquid collection apparatus which is not anticipated, rendered obvious, suggested, or even implied by any of the prior art liquid draining apparatus, either alone or in any combination thereof.

It is another object of the present invention to provide a new liquid collection apparatus which may be easily and efficiently manufactured and marketed.

It is a further object of the present invention to provide a new liquid collection apparatus which is of a durable and reliable construction.

An even further object of the present invention is to provide a new liquid collection apparatus which is susceptible of a low cost of manufacture with regard to both materials and labor, and which accordingly is then susceptible of low prices of sale to the consuming public, thereby making such liquid collection apparatus economically available to the buying public.

Still yet another object of the present invention is to provide a new liquid collection apparatus which provides in the apparatuses and methods of the prior art some of the advantages thereof, while simultaneously overcoming some of the disadvantages normally associated therewith.

Still another object of the present invention is to provide a new liquid collection apparatus for easily collecting and disposing of liquid waste such as oil.

Yet another object of the present invention is to provide a new liquid collection apparatus which includes a container member having end walls, an open top, and a bottom wall which has a first and second side portions which are slanted downwardly and toward a centrally-disposed longitudinal channel with the bottom wall being slanted downwardly from one end wall to the other end wall; and also includes a spigot member securely disposed in the other end wall; and further either includes a plurality of compartments disposed inside the container member and being spaced above the bottom wall with a screen member disposed between the bottom of the compartments and the bottom wall or includes a base member having pole-like support members extending upwardly therefrom with each pole-like support member having branch members which are adapted to support an upside down liquid-containing member.

Still yet another object of the present invention is to provide a new liquid collection apparatus that allows the user to quickly and conveniently empty a multiple number of liquid-containing members at the same time.

Even still another object of the present invention is to provide a new liquid collection apparatus that eliminates a mess usually created when the user tries to empty an oil container in another container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
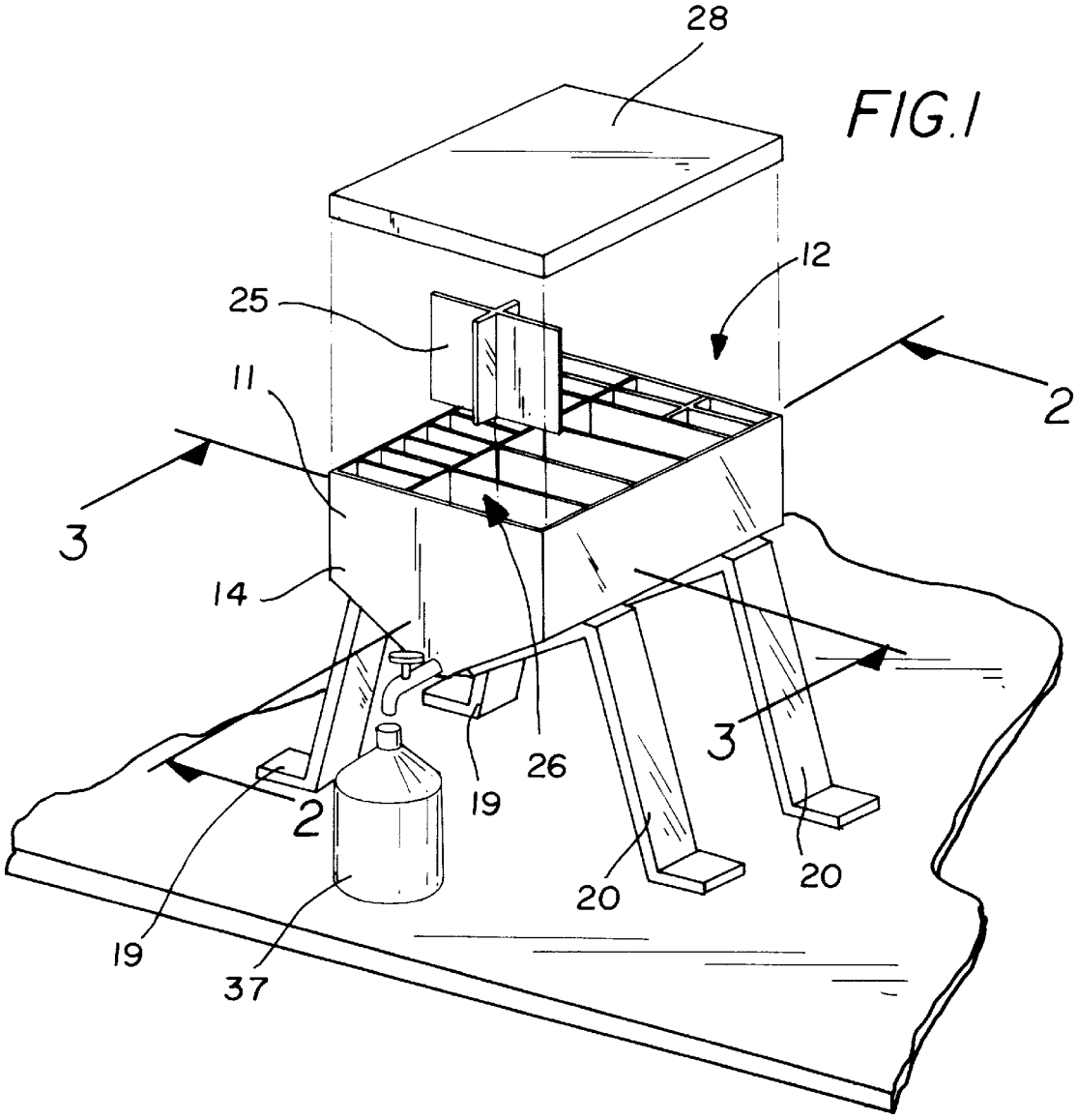
FIG. 1 is a perspective view of a first embodiment of a new liquid collection apparatus according to the present invention.
Figure 2:
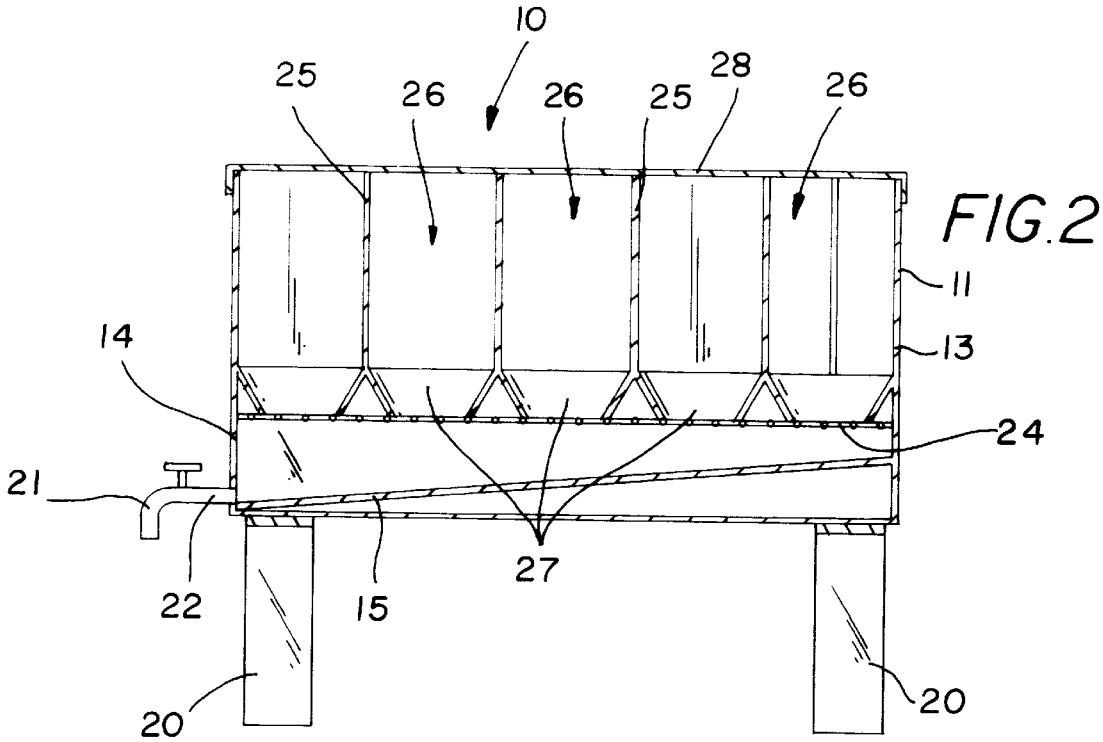
FIG. 2 is a side cross-sectional view of the first embodiment of the present invention.
Figure 3:
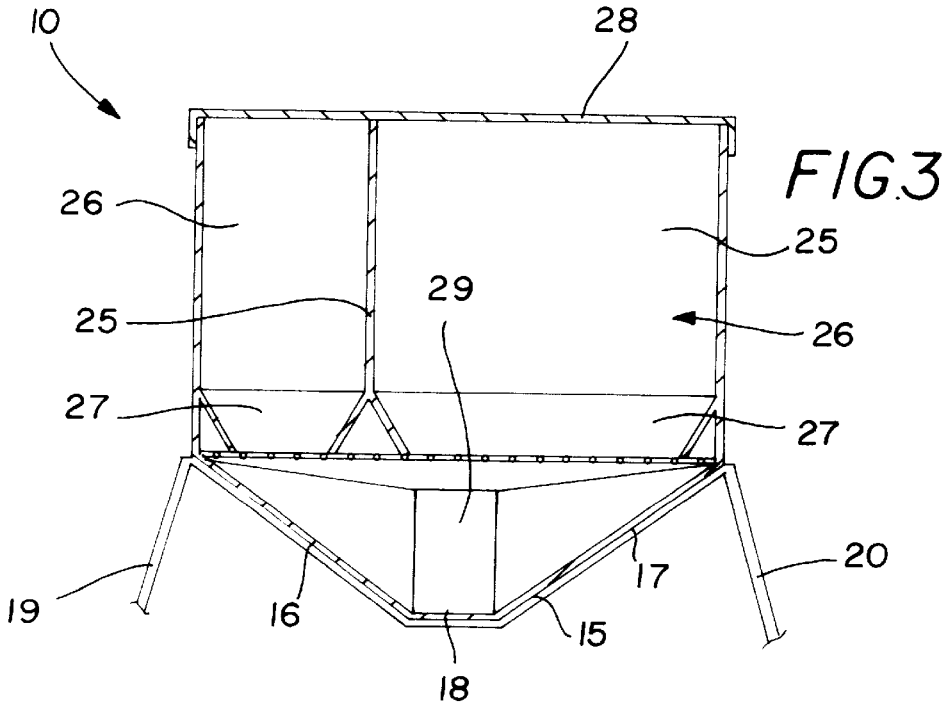
FIG. 3 is an end cross-sectional view of the first embodiment of the present invention.
Figure 4:
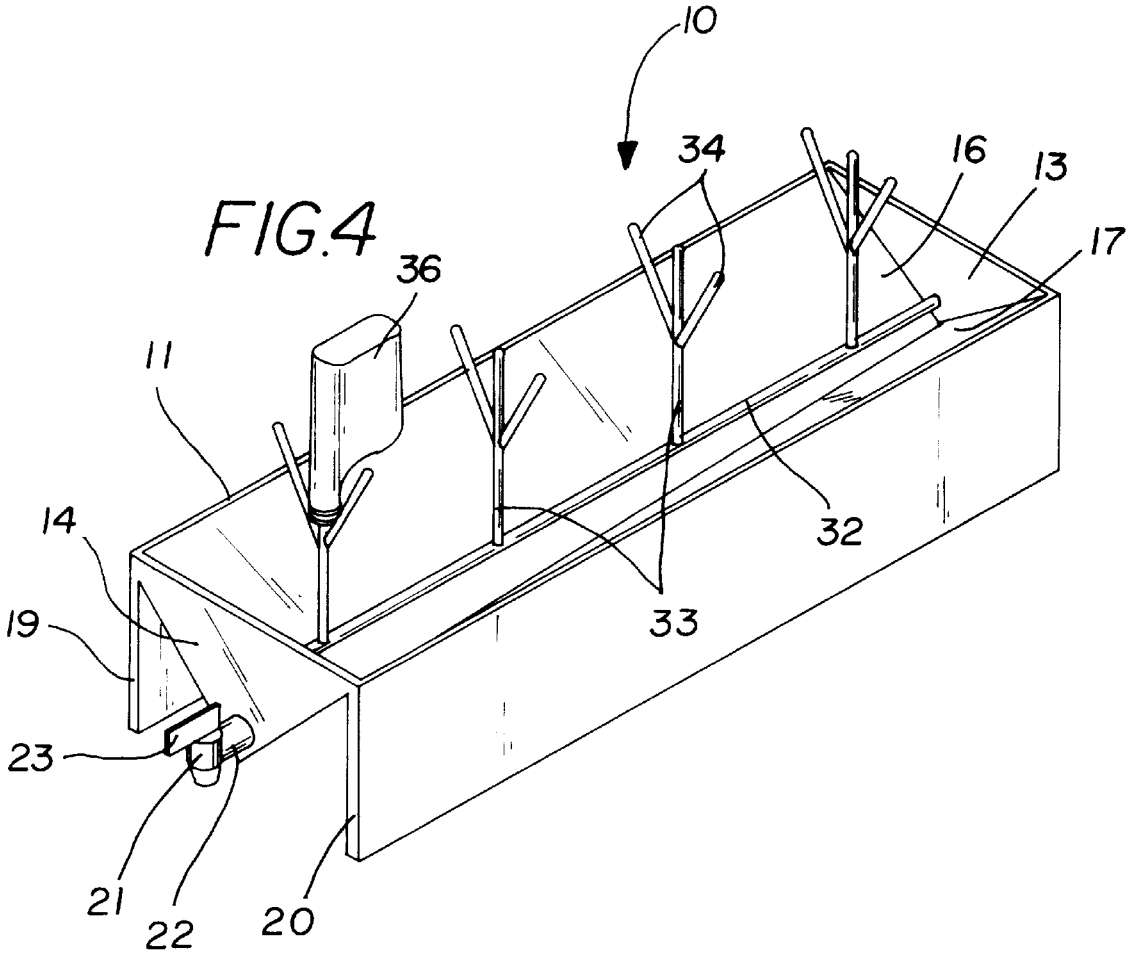
FIG. 4 is a perspective view of a second embodiment of the present invention.
Figure 5:
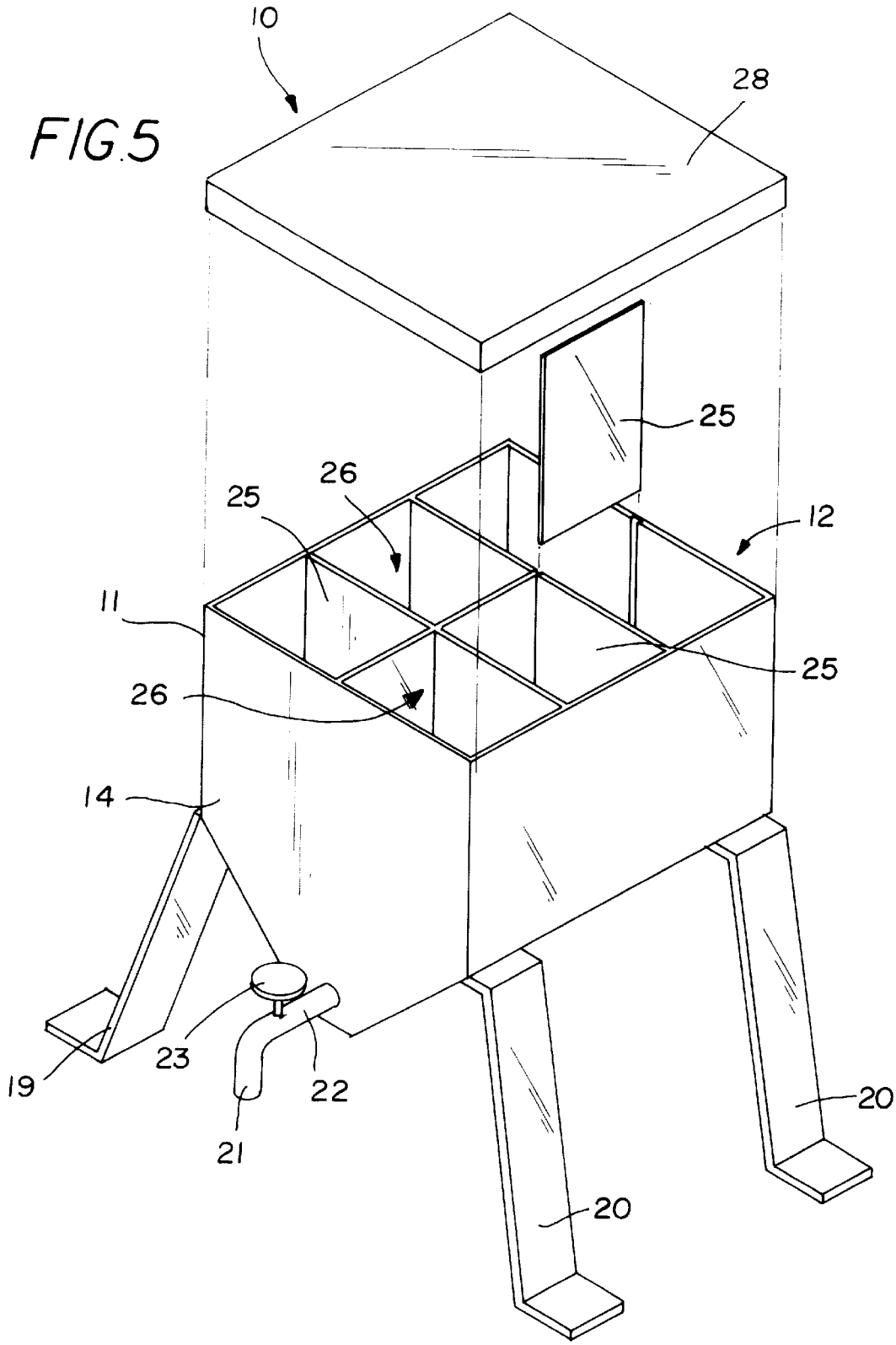
FIG. 5 is a perspective view of a smaller version of the first embodiment of the present invention.

With reference now to the drawings, and in particular to FIGS. 1 through 5 thereof, a new liquid collection apparatus embodying the principles and concepts of the present invention and generally designated by the reference numeral 10 will be described.

As best illustrated in FIGS. 1 through 5, the liquid collection apparatus 10 generally comprises a container member 11 having end walls 13,14, a bottom wall 15, an open top 12, and a plurality of legs 19,20 depending therefrom. The bottom wall 15 includes a first side portion 16, a second side portion 17, and a centrally-disposed longitudinal channel 18 disposed between the side portions 16,17 and extending from a first one of the end walls 13 to a second one of the end walls 14. The side portions 16,17 are slanted downwardly toward the longitudinal channel 18 with the bottom wall 15 being slanted downwardly from the first one of the end walls 13 to the second one of the end walls 14. A spigot member 21 extends into the container member 11 for regulating flow of liquid therefrom. The spigot member 21 is securely and conventionally disposed in and through the second one of the end walls 14 of the container member 11 and includes a conduit member 22 and a valve member 23 disposed in the conduit member 22 for controlling flow of liquid from the container member 21.

As a first embodiment of the liquid collection apparatus 10, a means for supporting and draining liquid-containing members includes a plurality of partitions 25 conventionally disposed inside the container member 11; and further includes a plurality of compartments 26 formed by the partitions 25; and also includes a screen member 24 securely and conventionally disposed below the compartments 26 and above the bottom wall 15 for filtering particles from the liquid. Each of the compartments 26 includes a funnel-like portion 27 at a bottom thereof. Each of the partitions 25 of a particular compartment 26 has a bottom portion which is angled downwardly and inwardly of the compartment 26 thus forming the funnel-like portion 27. Each of the compartments 26 is adapted to support an upside down liquid-containing member 36 thereupon. The partitions 25 are spaced above the bottom wall 15. Additionally, a cover member 28 is used to close over the open top 12 of the container member 11.

As a second embodiment of the liquid collection apparatus 10, the means for supporting and draining liquid-containing members includes an elongate base member 32 which is disposed upon the bottom wall 15 of the container member 11; a plurality of pole-like support members 33 being securely and conventionally attached to and spaced along the base member 32 and extending upwardly from the base member 32 for supporting the liquid-containing members 36. Each of the pole-like support members 33 includes a plurality of branch members 34 securely and conventionally attached thereto and extending upwardly and outwardly at an angle of the pole-like support member 33. Each of the branch members 34 is adapted to support an upside down liquid-containing member 36.

In use, the user tips a liquid-containing member 36 such as an oil bottle upside down on top of either one of the compartments 26 or one of the pole-like support members 33; whereupon, the liquid such as oil is drained and emptied from the liquid-containing member 36 either into the compartment 26 or upon the bottom wall 15. The liquid flows toward the second one of the end walls 14 where the spigot member 21 is located. The user places a receptacle member 37 under the spigot member 21 and opens the valve member 23 to allow the liquid to empty into the receptacle member 37, and then closes the valve member 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A liquid collection apparatus comprising:

a container member having end walls a bottom wall an open top, and a plurality of legs depending therefrom; said bottom wall including a first side portion, a second side portion, and a centrally-disposed longitudinal channel disposed between said side portions and extending from a first one of said end walls to a second one of said end walls, said side portions being slanted downwardly toward said longitudinal channel, said bottom wall being slanted downwardly from said first one of said end walls to said second one of said end walls;

a means for supporting and draining liquid-containing members including a plurality of partitions removably disposed inside said container member; a plurality of compartments formed by said partitions; a screen member securely disposed below said compartments and above said bottom wall for filtering particles from the liquid;

a spigot member extending into said container member for regulating flow of liquid therefrom, said spigot member being securely disposed in and through said second one of said end walls of said container member, said spigot member including a conduit member and a valve member disposed in said conduit member for controlling flow of liquid from said container member; and each of said compartments including a funnel-like portion at a bottom thereof, said partitions of a particular said compartment each having a bottom portion which is angled downwardly and inwardly of said compartment thus forming said funnel-like portion, each of said compartments being adapted to support an upside down liquid-containing member thereupon.

2. A liquid collection apparatus as described in claim 1, wherein said partitions are spaced above said bottom wall.

3. A liquid collection apparatus as described in claim 1, further comprises a cover member adapted to cover over said open top of said container member.

4. A liquid collection apparatus comprising:

a container member having end walls, a bottom wall an open top, and a plurality of legs depending therefrom, said bottom wall including a first side portion, a second side portion, and a centrally-disposed longitudinal channel disposed between said side portions and extending from a first one of said end walls to a second one of said end walls, said side portions being slanted downwardly toward said longitudinal channel, said bottom wall being slanted downwardly from said first one of said end walls to said second one of said end walls;

a means for supporting and draining liquid-containing members;

a spigot member extending into said container member for regulating flow of liquid therefrom, said spigot member being securely disposed in and through said second one of said end walls of said container member, said spigot member including a conduit member and a valve member disposed in said conduit member for controlling flow of liquid from said container member; and said means for supporting and draining liquid-containing members including a plurality of removal partitions disposed inside said container member; a plurality of compartments formed by said partitions; a screen member securely disposed below said compartments and above said bottom wall for filtering particles from the liquid, each of said compartments including a funnel-like portion at a bottom thereof, said partitions of a particular said compartment each having a bottom portion which is angled downwardly and inwardly of said compartment thus forming said funnel-like portion, each of said compartments being adapted to support an upside down liquid-containing member thereupon, said partitions being spaced above said bottom wall.

* * * * *